US005678311A

United States Patent [19]

Avidor

[11] Patent Number: 5,678,311

[45] Date of Patent: Oct. 21, 1997

[54] SHAVING APPARATUS

[76] Inventor: Joseph Avidor, 20 Hapardes Street, Ramat Hasharon 47405, Israel

[21] Appl. No.: 409,174

[22] Filed: Mar. 23, 1995

[30] Foreign Application Priority Data

Feb. 14, 1995 [IL] Israel ..... 112644

[51] Int. Cl.[6] ..... B26B 19/42; B26B 21/08

[52] U.S. Cl. ..... 30/34.2; 30/50; 30/51

[58] Field of Search ..... 30/34.2, 34.05, 30/77, 81, 82, 83, 51, 50

[56] References Cited

U.S. PATENT DOCUMENTS

| | | | |
|---|---|---|---|
| 1,404,603 | 1/1922 | Gray | 30/34.2 |
| 1,777,691 | 10/1930 | Connolly . | |
| 1,833,079 | 11/1931 | Holtzman . | |
| 2,101,737 | 6/1937 | Gesler | 30/83 |
| 2,559,189 | 7/1951 | Griffin | 30/83 |
| 2,711,582 | 6/1955 | Scully | 30/34.2 |
| 2,734,266 | 2/1956 | Schreyer | 30/83 |
| 2,837,820 | 6/1958 | Ostrowski | 30/51 |
| 2,880,503 | 4/1959 | Carissimi | 30/83 |
| 2,952,907 | 9/1960 | Miller . | |
| 3,138,865 | 6/1964 | Meyer . | |
| 3,183,591 | 5/1965 | Dumont | 30/34.05 |
| 3,802,072 | 4/1974 | Wintercorn | 30/81 |
| 4,044,463 | 8/1977 | Tietjens . | |
| 4,189,832 | 2/1980 | Harper et al. . | |
| 4,378,633 | 4/1983 | Jacobson | 30/77 |
| 4,741,103 | 5/1988 | Hultman . | |
| 5,022,154 | 6/1991 | Johnson | 30/34.2 |
| 5,251,376 | 10/1993 | Althaus et al. | 30/51 |

FOREIGN PATENT DOCUMENTS

| | | | |
|---|---|---|---|
| 1 015 370 | 9/1952 | France | 30/34.2 |
| 6 142 351 | 5/1994 | Japan | 30/34.2 |
| 460 684 | 2/1937 | United Kingdom | 30/34.2 |

*Primary Examiner*—Kenneth E. Peterson
*Assistant Examiner*—Sean A. Pryor
*Attorney, Agent, or Firm*—Ladas & Parry

[57] ABSTRACT

Shaving apparatus includes a shaver head movable across the user's skin to be shaved of hair, and a cutter device carried by the shaver head and extending transversely to the direction of movement of the shaver head across the user's skin. The apparatus further includes a hair erecting device forwardly of and adjacent to the cutter device for moving the hairs towards an erect position prior to their engagement with the cutter device. The hair erecting device includes a rotary assembly carrying on its outer surface a plurality of protrusions or fins configured to engage the hairs and to move them towards an erect position during the rotation of the rotary assembly.

6 Claims, 6 Drawing Sheets

SHAVING APPARATUS

FIELD AND BACKGROUND OF THE INVENTION

The present invention relates to a shaving apparatus and method, and particularly to such an apparatus and method wherein a hair erecting device moves the hairs towards an erect position prior to their being cut.

A showing apparatus of the foregoing type is known particularly in manual shavers including a shaver head and one or more razor blades. One known manual shaver of this type is called the "Gillette Sensor EXCEL". This manual shaver includes a series of soft, flexible, microfins ahead of the razor blades, which fins are said to stretch the skin and to cause the hairs to spring upward so the blade can shave closer. Other constructions have been described in the patent literature for stretching the skin prior to engagement by the cutter device, as shown for example in U.S. Pat. Nos. 1,777,691, 1,833,079, 3,138,865, 4,044,463, 4,189,832 and 4,741,103 for manual shavers, and U.S. Pat. No. 2,952,907 for electrical shavers.

OBJECTS AND BRIEF SUMMARY OF THE INVENTION

An object of the present invention is to provide shaving apparatus having a novel hair erecting device for moving the hairs towards an erect position prior to their engagement by the blades.

According to the present invention, there is provided a shaving apparatus, comprising: a shaver head movable across the user's skin to be shaved of hair, and a cutter device carried by the shaver head and extending transversely to the direction of movement of the shaver head across the user's skin; characterized in that the apparatus further includes a hair erecting device forwardly of and adjacent to the cutter device for moving the hairs towards an erect position prior to their engagement with the cutter device; the hair erecting device comprising a rotary assembly having an outer surface configured to engage the hairs and to move them towards an erect position during the rotation of the rotary assembly.

Preferably, the outer surface of the rotary assembly is formed with protrusions which engage the hairs and move them to an erect position. Such a construction is believed to be more effective in erecting the hairs before their engagement by the cutter device than, for example, the shavers including static microfins which merely stretch the skin to cause the hairs to spring upwardly. Accordingly, shaving apparatus constructed in accordance with the foregoing features is believed capable of providing a closer shave than apparatus including static microfins.

According to further features in the described preferred embodiments, the protrusions are in the form of fins extending along the length of the rotary assembly. In the described preferred embodiments, each fin has a first face defining a large angle with the tangent to the surface of the rotary member, and a second face defining a small angle with the tangent to the surface of the rotary member. The rotary member is oriented and rotated such that the first face of the fins first engages the hairs and moves them towards an erect position and the second face of the fins then engages the hairs to maintain them erect before their engagement by the cutter device.

According to further features in some described embodiments, the rotary assembly includes a cylindrical roller, whereas in another described embodiment it includes a closed loop web supported and rotated by a pair of rotary members at its opposite ends. Further embodiments are described wherein the rotary assembly includes a first cylinder rollable along the skin to rotate the cylinder, and a second cylinder carrying the protrusion and coupled to the first cylinder by a step-up transmission which rotates the second cylinder and its protrusions at a larger rotary velocity than that of the first cylinder.

The invention is described below primarily as embodied in a manual shaver wherein the cutter device comprises a razor blade assembly included in the shaver head and carried by a handle graspable by the user for moving the shaver head across the user's skin to be shaved. The hair erecting rotary assembly may be incorporated with the razor blade assembly in a common replaceable cartridge; alternatively, the hair erecting rotary assembly could be incorporated in the handle so that it would not be replaced with the razor blade cartridge.

A further embodiment is described wherein the apparatus is an electrical shaver, and the cutter device includes blades driven by an electrical motor.

According to another aspect of the present invention, there is provided shaving apparatus comprising: a shaver head movable across the user's skin to be shaved of hair; a cutter device carried by the shaver head and extending transversely to the direction of movement of the shaver head across the user's skin; and a pair of rollers on opposite sides of the shaver head mounted for rotation on an axis extending parallel to that of the cutter device, each of the rollers having a skin engaging surface effective to constrain movement of the shaver head to a direction perpendicular to the axis of the rollers, and the axis of the cutter device. Such rollers, which may be part of the hair erecting device, thereby decrease the danger of moving the shaver head such as to cause the cutter device (e.g., one or more razor blades) to cut the user's skin.

According to a still further aspect of the present invention, there is provided a method of shaving hairs from a user's skin by moving a cutter device across the user's skin to engage and cut the hairs, and causing the hairs to move towards an erect position before their engagement by the cutter device; characterized in that the hairs are caused to move towards an erect position by engaging them, just prior to their engagement by the cutter device, with protrusions formed on the outer surface of a rotary assembly rolled along the user's skin forwardly of the cutter device.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
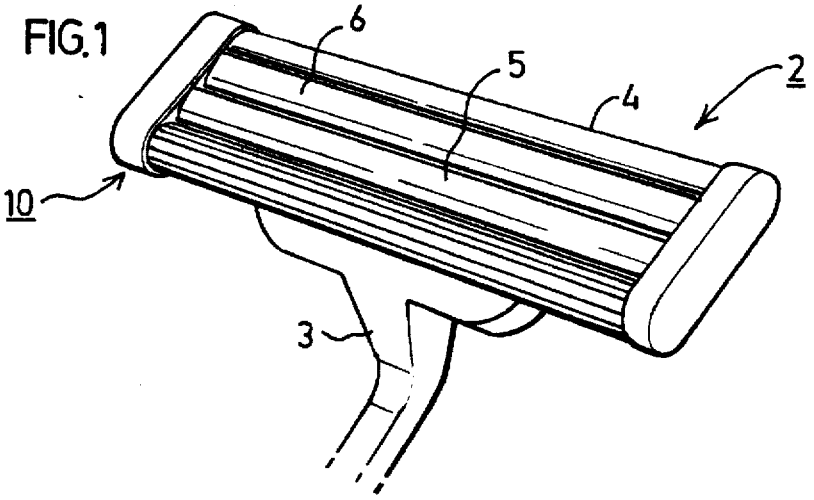
FIG. 1 illustrates one form of manual shaver constructed in accordance with the present invention.
Figure 2:
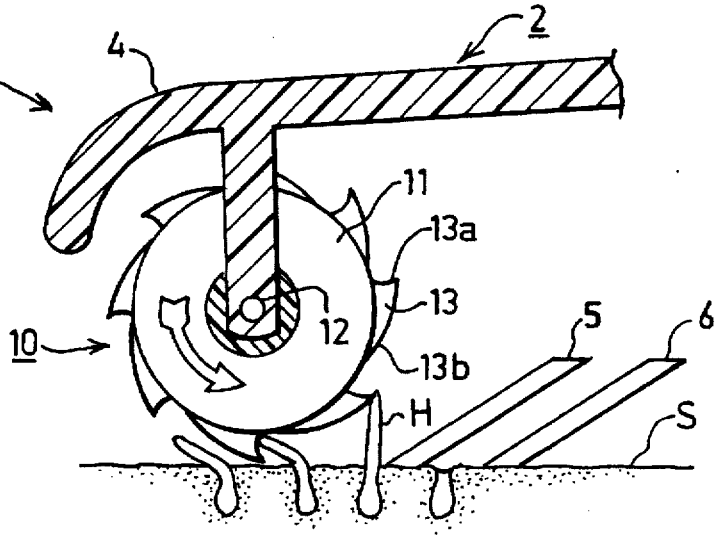
FIG. 2 is an enlarged fragmentary view illustrating the hair erecting assembly in the shaver of FIG. 1.

The shaving apparatus illustrated in FIGS. 1 and 2 is a manual shaver. It includes a shaver head 2 carried on a handle 3 which is graspable by the user for moving the shaver head across the user's skin (e.g., face) to be shaved of hair. Shaver head 2 includes a housing for carrying a pair of blades 5, 6, in spaced relation to each other and angled such as to cut the hairs as the shaver head is moved across the user's skin. Such shaver heads are commonly constructed in the form of replaceable cartridges detachable from the handle 3. Since such manual shavers are well known, further details of its construction are not set forth herein.

According to the present invention, the shaver head 2 is provided with a hair erecting device in the form of a rotary assembly, generally designated 10 forwardly of and adjacent to the leading razor blade 5 for moving the hairs towards an erect position prior to their engagement by that razor blade.

The rotary assembly 10 is more particularly illustrated in FIG. 2. It includes a cylindrical rotary member 11 rotatably mounted on an axis 12 supported by the shaver housing 4 just forwardly of the leading razor blade 5 and parallel to the axis of that razor blade. Cylindrical member 11 is formed on its outer surface with a plurality of protrusions 13 configured to engage the hairs H and to move them towards an erect position during the rotation of cylinder 11 before such hairs are engaged by the leading razor blade 5.

The protrusions 13 are in the form of fins extending lengthwise of the rotary cylinder 11. Each fin 13 has a first face 13a defining a large angle with a tangent of the surface of cylinder 11, and a second face 13b defining a smaller angle with the tangent of the surface of the cylinder. As shown particularly in FIG. 2, cylinder 11 is rotated such that face 13a of the fins 13 first engage the hairs H and move them towards an erect position, and face 13b of the fins then engage the hairs to maintain them in such an erect position before the hairs are engaged by the first leading razor blade 5. Such a construction thus better assures that the hairs will be neatly cut adjacent to their roots, thereby producing a close shave.

The leading razor blade 5 also gently stretches the skin S between it and the trailing razor blade 6. This stretching of the skin by the leading razor blade 5 causes hairs uncut by it, or the remnants of hairs cut by it, to move towards an erect position for cutting by the trailing razor blade 6.

It will thus be seen that in the hair razor device illustrated in FIG. 2, there is a combination of different actions for better assuring that the hairs will be cut close to their roots. Thus, the engagement of the fins 13 with the hairs H moves the hairs towards an erect position preparatory for cutting by the leading razor blade 5; and the stretching of the skin by the leading razor blade 5 also tends to move to an erect position any hairs uncut by it, or the remnants of hairs by it, preparatory to being cut by the trailing razor blade 6.

Preferably, the leading face 13a of each fin 13 is of a concave configuration, and the trailing face 13b of each fin is of a convex configuration. Also, each fin has a relatively thick base decreasing in thickness to its outer tip. Fins 13 may be conveniently formed integrally with cylinder 11 of any suitable material. Preferably, the material is of a flexible elastomeric material, such as natural or synthetic rubber.

Figure 3:
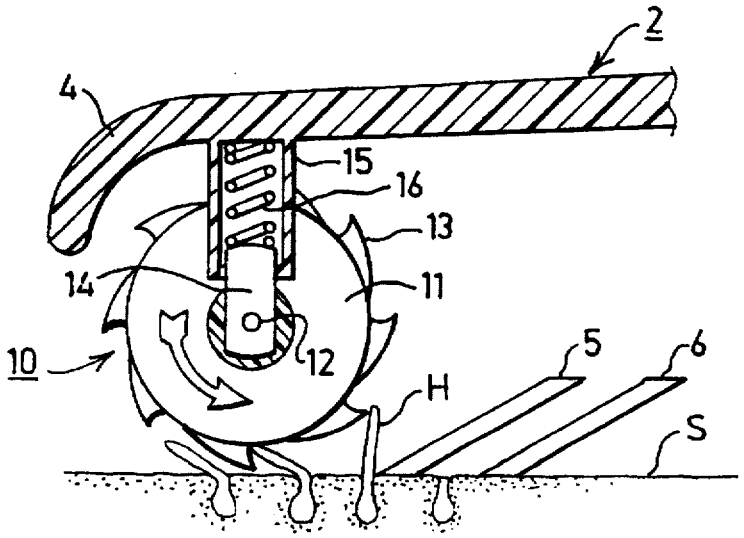
FIG. 3 is a view similar of that of FIG. 2 but illustrating a modification in the construction of the hair erecting assembly.

FIG. 3 illustrates a modification in the construction of the rotary hair erecting assembly 10 of FIG. 2. In this modification, the rotary cylinder 11 is floatingly mounted with respect to housing 4 of the shaver head 2. For this purpose, axis 12 of rotary cylinder 11 is carried by a pair of mounting pins 14 received within a pair of hollow stems 15 of shaver housing 4 and spring-urged to an outer position with respect to the stems by a spring 16. Thus, the floating construction illustrated in FIG. 3 enables the rotary cylinder 11, and particularly its hair erecting fins 13, to more closely follow the contour of the user's skin S when engaging and erecting the hairs H.

Figure 4:
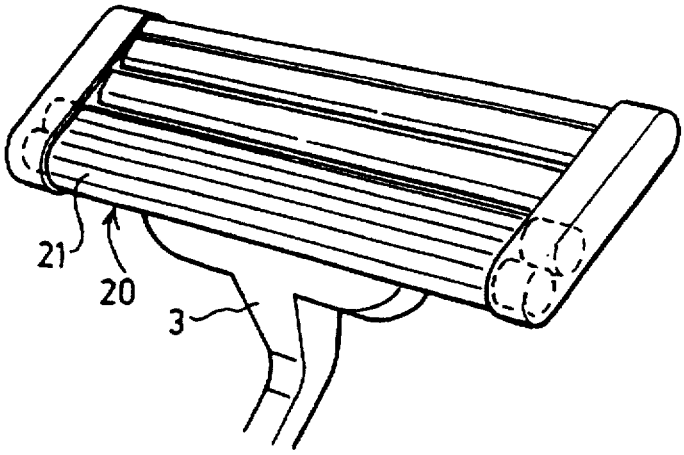
FIG. 4 illustrates another form of manual shaver constructed in accordance with the present invention.
Figure 5:
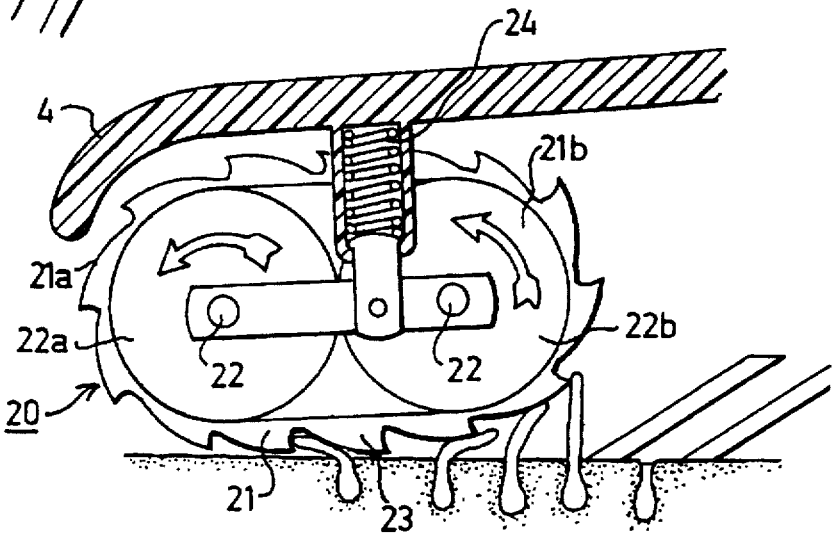
FIG. 5 is an enlarged fragmentary view illustrating the hair erecting assembly in the shaver of FIG. 4.

FIGS. 4 and 5 illustrate a further modification in the construction. In this case, the rotary hair erecting assembly, therein generally designated 20, includes a closed loop web 21 supported and rotated by a pair of rotary members 22a, 22b, at the opposite ends of the web. The web 21 is formed with the hair erecting protrusions or fins 23 which operate in substantially the same manner as described above with respect to FIGS. 1 and 2. In the construction of FIGS. 4 and 5, the rotary hair erecting assembly 20 is also floatingly mounted by the spring 24 so as to closely follow the contour of the user's skin.

Figure 6A:
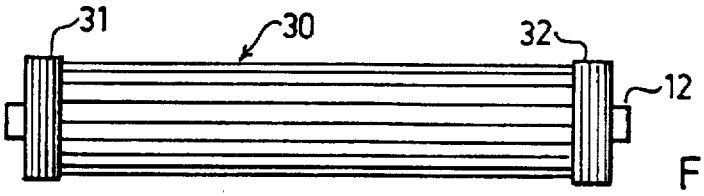
FIG. 6a is a side elevational view of the hair erecting assembly in the shaver of FIG. 6.
Figure 6:
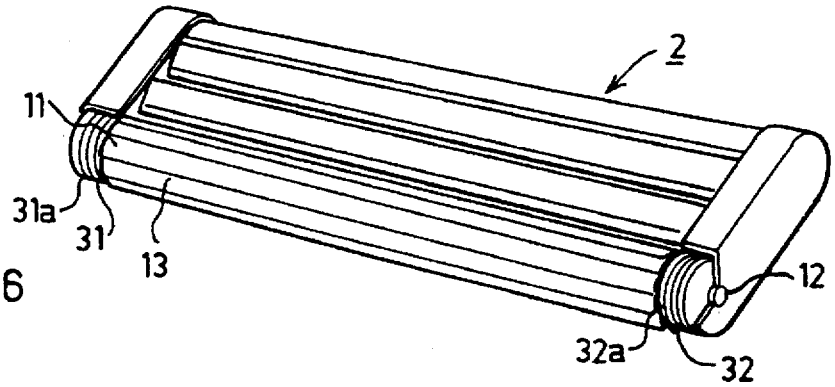
FIG. 6 illustrates a further form of manual shaver constructed in accordance with the present invention.

FIGS. 6 and 6a illustrate a construction similar to that of either of FIGS. 1, 2 or FIG. 3, namely one having a rotary hair erecting assembly, therein generally designated 30, including a rotatable cylinder 11 rotatably mounted about an axis 12 and formed with the protrusions or fins 13 which engage the hairs and move them towards the erect position by the rotation of cylinder 11 to prepare the hairs for severance by the razor blades. The rotary assembly 30 in FIGS. 6 and 6a is preferably floatingly mounted as shown in FIG. 3 by spring 16 (FIG. 3).

The rotary assembly 30 in FIGS. 6 and 6a, however, includes a pair of rollers 31, 32 at the opposite ends of the assembly mounted for rotation with cylinder 11 on shaft 12. The end rollers 31, 32 are of a diameter so as to engage the user's skin when the shaver head is moved along it to rotate cylinder 11' and its fins 13. The two end rollers 31, 32, however, are provided with a plurality of circumferentially-extending ribs, as shown at 31a and 32a, respectively, which are axially spaced from each other. These ribs engage the skin of the user such as to restrain movement of the cutter head in the axial direction, i.e., parallel to axis 12, and thereby constrain movement of the shaver head to a direction perpendicular to the axis 12 of the rollers, and the axis of the razor blades 5, 6, carried by the shaver head. This arrangement thus reduces the danger of cutting or nicking the user's skin while shaving.

Figure 7:
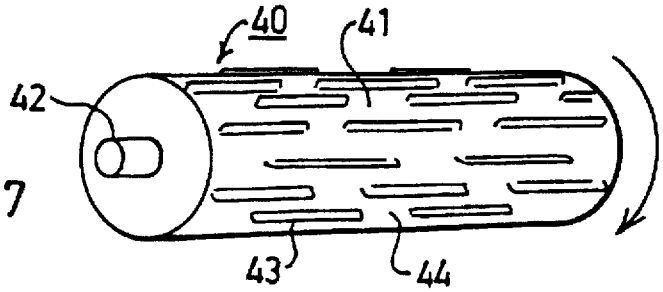
FIG. 7 illustrates another form of hair erecting assembly in accordance with the present invention.

FIG. 7 illustrates a modification in the rotary hair erecting assembly, therein generally designated 40, also including a cylinder 41 rotatable about an axis 42 and formed with a plurality of longitudinally-extending protrusions or fins 43. In the construction in FIG. 7, however, the fins 43 are not continuous, but rather are formed with interruptions 44, with the interruptions being in staggered relationship from one fin to the other, such that any hairs skipped by one fin will be engaged by the next.

Figure 8:
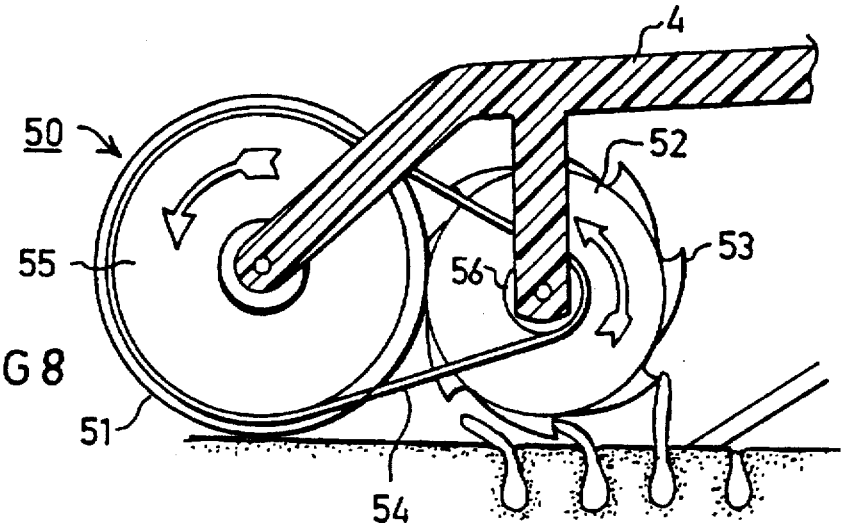
FIGS. 8 and 9 are fragmentary views illustrating two further forms of the hair erecting assemblies in accordance with the present invention.

FIG. 8 illustrates another construction, wherein the rotary hair erecting assembly, therein generally designated 50, includes a first cylinder or roller 51 which is rollable along the user's skin, and a second cylinder 52 which is formed with the hair erecting protrusions or fins 53. Cylinder 52 is coupled to cylinder 51 by means of a step-up transmission, as described below, which rotates roller 52 at a larger rotary velocity than that of cylinder 51. Thus, the fins 53 formed in cylinder 52 will rotate at a larger angular velocity than cylinder 51 to engage the hairs, move them towards the erect position, and retain them in such position preparatory to being cut by the razor blades.

Figure 9:
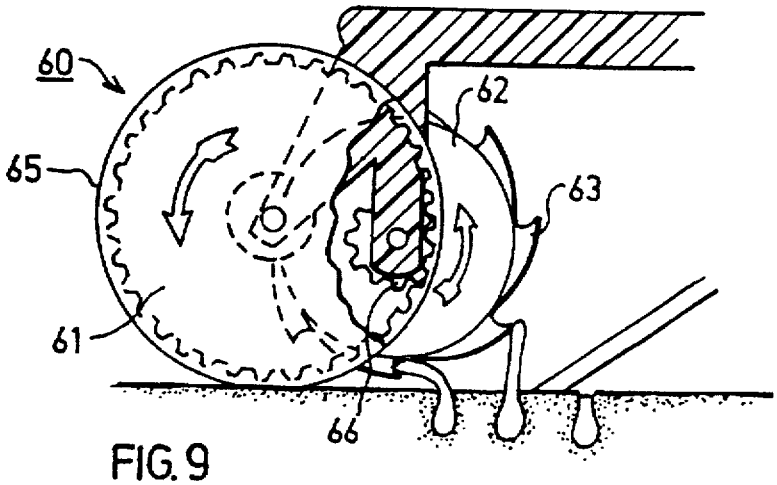

In FIG. 8, the step-up transmission is shown as including a pulley belt 54 coupled between a large pulley 55 on cylinder 51, and a smaller pulley 56 on cylinder 52. FIG. 9 illustrates a similar arrangement including a step-up gear transmission.

Thus, the rotary hair erecting assembly in FIG. 9, therein designated 60, also comprises a first cylinder 61 rotatable along the user's skin, and a second cylinder 62 formed with the hair erecting protrusions or fins 63 which are rotated by the rotation of cylinder 61. In this case, the gear step-up transmission includes a large ring gear 65 fixed to cylinder 61, and a smaller gear 66 fixed to cylinder 62, such that the rotation of cylinder 61, when moved along the user's skin, also rotates cylinder 62 but at a higher rotary velocity.

Figure 10:
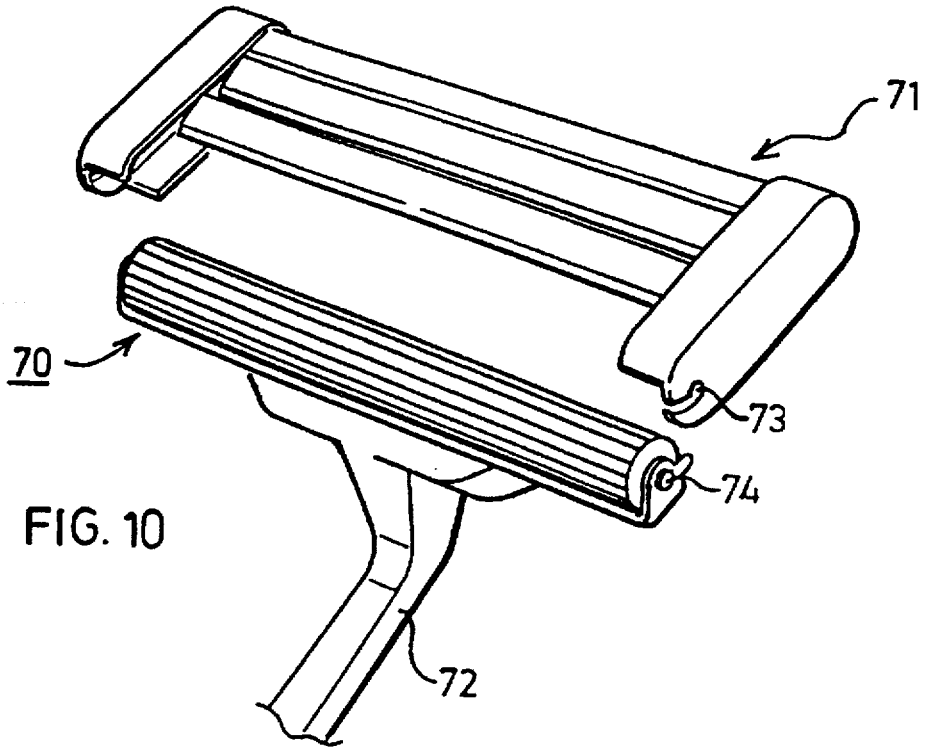
FIG. 10 illustrates a further manual shaver construction in accordance with the present invention.

In all the above-described constructions, the rotary hair erecting assembly is shown as incorporated into the cartridge containing the razor blades 5, 6, so that it is also automatically replaced when introducing a new cartridge containing new razor blades. FIG. 10 illustrates a modification wherein the rotary hair erecting assembly, generally designated 70, is not incorporated into the same cartridge 71 as the razor blades, but rather is incorporated in the handle 72. Thus, in the arrangement illustrated in FIG. 10, only the razor blades are replaced with each cartridge change, and the rotary hair erector assembly 70 is retained permanently with the handle 72. The cartridge may be removably attached to the handle in any suitable manner, e.g., by bayonet slots 73 formed at the ends of the cartridge receivable within the opposite ends of shaft 74 of the rotary assembly 70.

Figure 11:
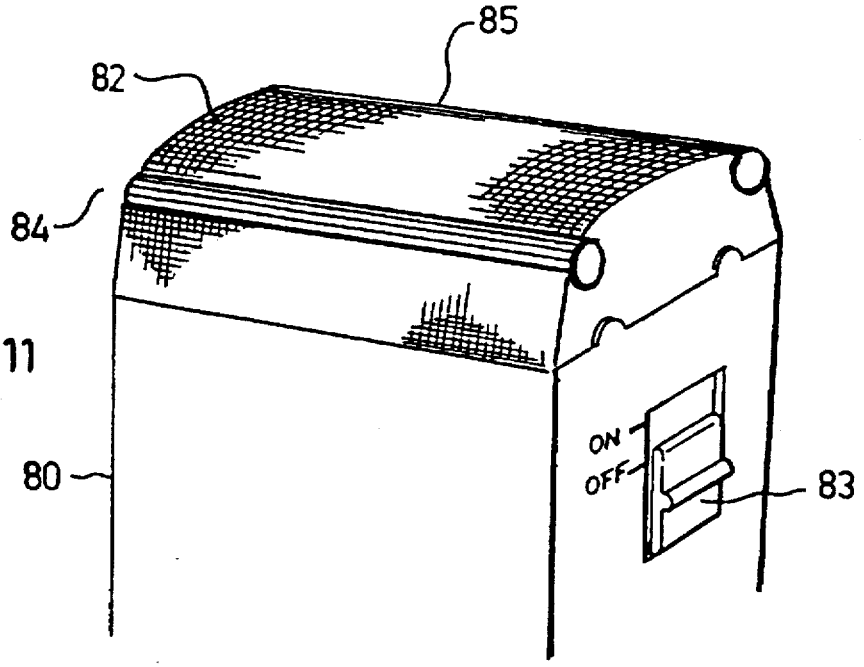
FIG. 11 illustrates an electrical shaver constructed in accordance with the present invention.

FIG. 11 illustrates the invention as embodied in an electric shaver 80, wherein the cutter device includes blades 82 driven by an electric motor (not shown) under the control of an electrical switch 83. In the construction illustrated in FIG. 11, two rotary hair erecting assemblies are provided, 84 and 85, respectively, on opposite sides of the blades 82 so as to be effective in either direction of movement of the electric razor over the skin of the user. The rotary assemblies 84, 85 may be rotated by rolling contact along the user's skin, or alternatively, by the motor within the electric razor 80 so as to have a rotary velocity larger than produced by rolling the assembly along the user's skin.

Figure 12:
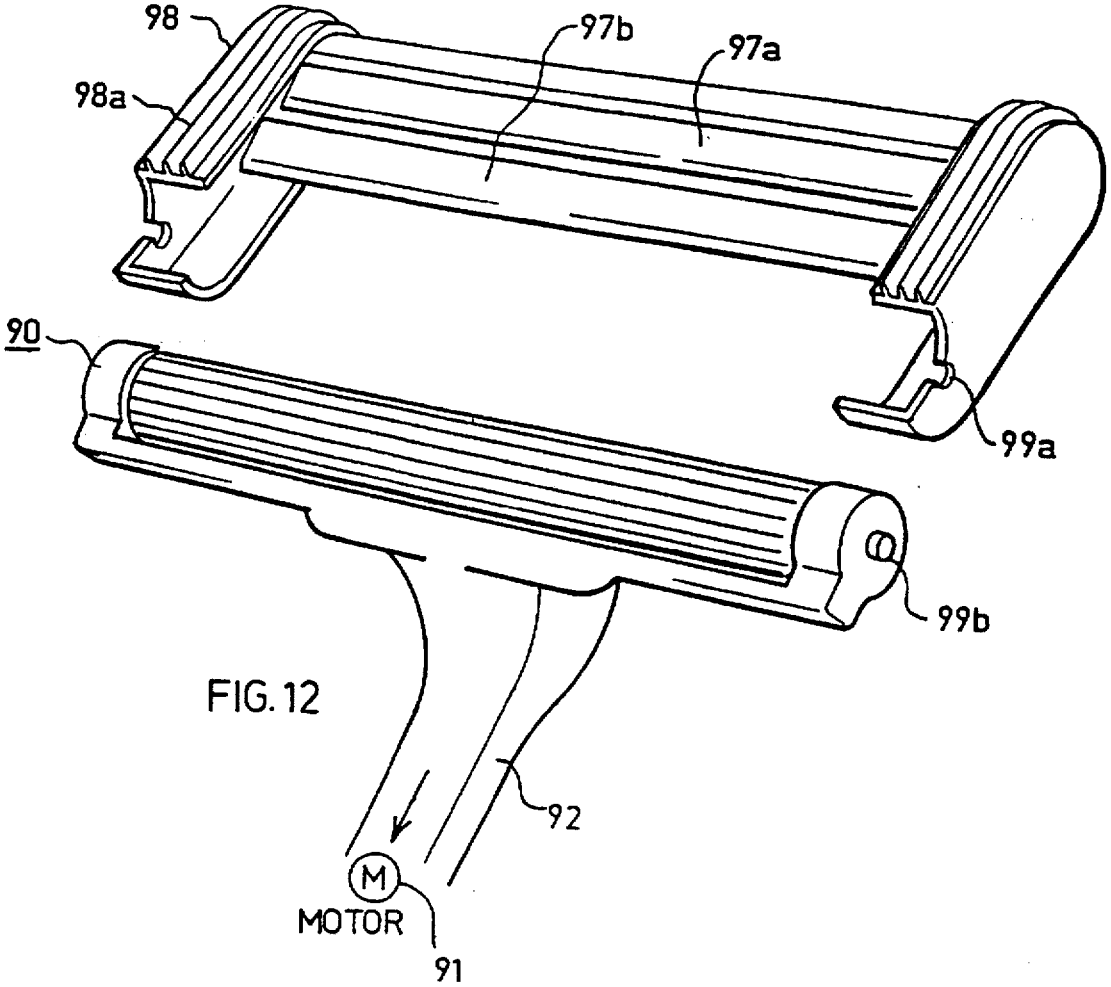
FIG. 12 is an exploded view illustrating another shaver in accordance with the invention.
Figure 13:
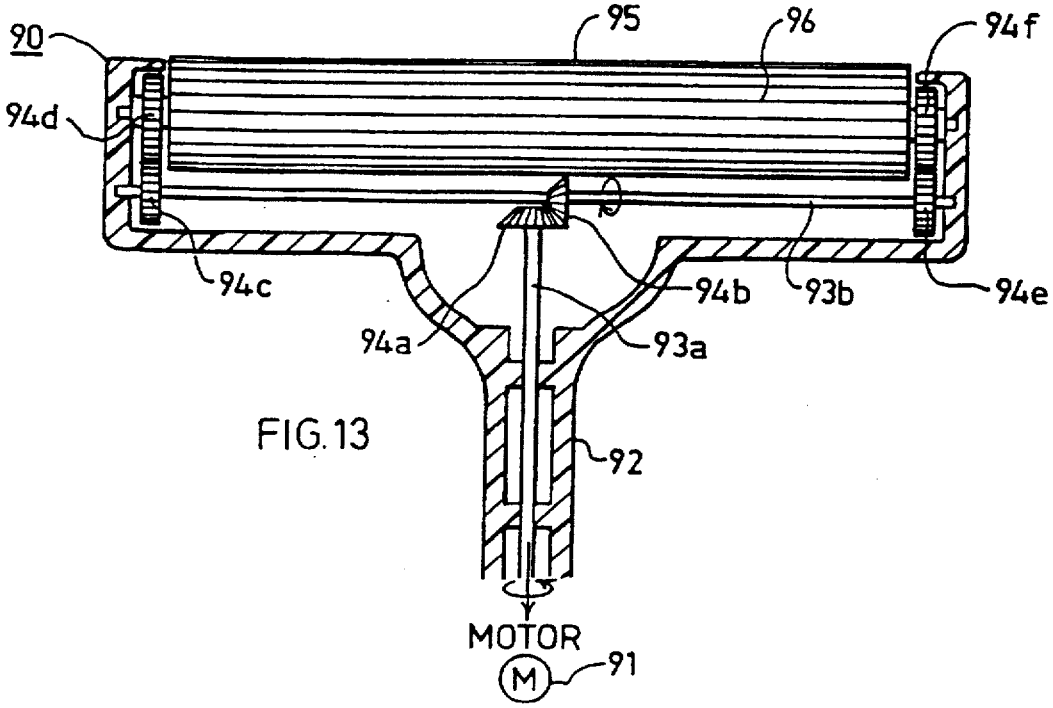
FIG. 13 is a sectional view of the shaver of FIG. 12.

FIGS. 12 and 13 illustrate a construction similar to that of FIG. 10, except the rotary hair erecting assembly, generally designated 90, is rotated by an electrical motor, shown schematically at 91 in FIG. 13, located in the handle 92 of the shaver and coupled to the assembly 90 by shafts 93*a*, 93*b*, and gears 94*a*–94*f*, which rotate the cylinder 95 containing the hair-erecting fins 96. The two razor blades 97*a*, 97*b* are contained within a cartridge 98 which is removably attachable to the rotary hair erecting assembly 90 by means of bayonet slots 99*a*, formed at the opposite ends of the cartridge, receivable within the opposite ends of shaft 99*b* of the rotary assembly 90. The opposite ends of cartridge 98 are formed with ribs 98*a* extending perpendicularly to the axis of the blades 97*a*, 97*b* of the cartridge. Ribs 98*a* serve a similar function as ribs 31*a*, 32*a* in rollers 31, 32 of the FIG. 6 construction, in that they tend to constrain the movement of the shaver head to the direction perpendicular to blades 97*a*, 97*b*, to reduce the danger of nicking the user's skin.

Figure 14:
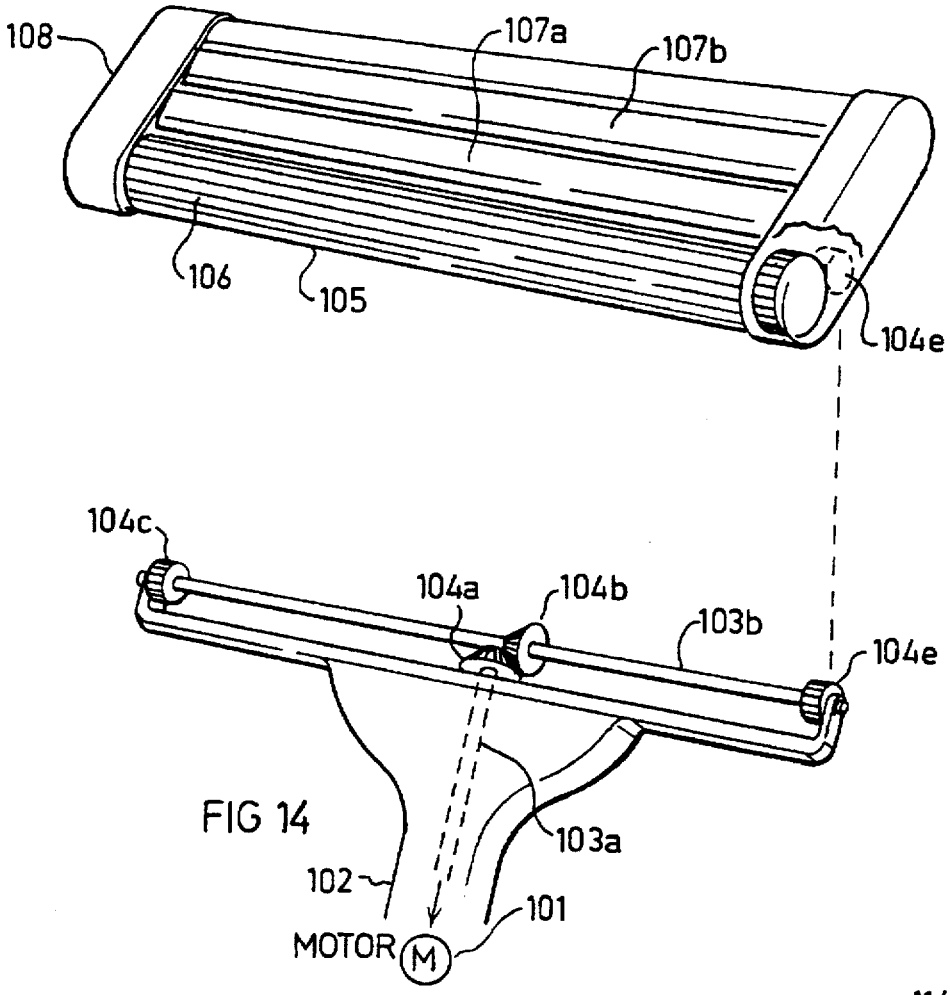
FIG. 14 is an exploded view illustrating a further shaver in accordance with the invention.

FIG. 14 illustrates a similar construction as that of FIGS. 12, 13, also including a motor 101 located within the handle 102 of the manual shaver and coupled by shafts 103*a*, 103*b* and gears 104*a*–104*e* to the rotary cylinder 105 formed with the hair erecting fins 106. In the construction of FIG. 14, however, the motor 101, its shafts 103*a*, 103*b*, and gears 104*a*–104*e* are all contained within the shaver handle 102; whereas the rotary cylinder 105 containing the hair erecting fins 106 is included within the replaceable cartridge 108 containing the razor blades 107*a*, 107*b* so that it will also be replaced with the replacement of the razor blades.

Figure 15:
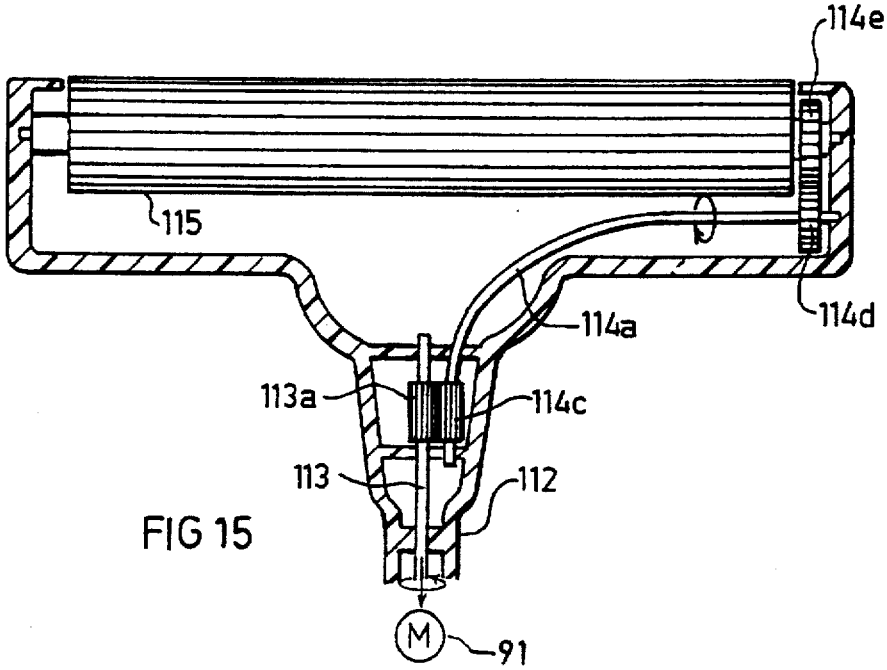
FIG. 15 is a sectional view illustrating a still further shaver in accordance with the invention.

FIG. 15 also illustrates a construction similar to that of FIGS. 12, 13, including a motor, as shown schematically at 91, incorporated within the handle 112 of a manual shaver for rotating the rotary hair-erecting cylinder 115. In this case, however, the transmission between the electric motor and the cylinder includes a first shaft 113 for rotating a first gear 113*a*, and a further shaft 114*a*, coupled to gear 113*a* to rotate cylinder 115, by gears 114*c*–114*e*. In the construction illustrated in FIG. 15, the rotary hair-erecting cylinder 115 may be part of the handle, as shown for example in FIGS. 12, 13, or a part of the replaceable blade cartridge as shown in FIG. 14, so as to be replaced therewith.

While the invention has been described with respect to several preferred embodiments, it will be appreciated that these are set forth merely for purposes of example, and that many variations may be made. For example, the outer surface of the rotary assembly could be formed with discrete protrusions, e.g., parallel lines of semi-spherical projections, etc. Many other variations, modifications and applications of the invention may be made.

I claim:

1. Shaving apparatus, comprising:

a shaver head carried at one end of a handle graspable by a user for moving the shaver head across the user's skin to be shaved of hair;

a cutter device carried by said shaver head and extending transversely to the direction of movement of the shaver head across the user's skin; and a hair erecting device forwardly of and adjacent to the cutter device for moving the hairs towards an erect position prior to their engagement with said cutter device;

said hair erecting device comprising a rotary assembly rotatably mounted to said handle about a rotary axis and having an outer surface formed with protrusions configured to engage the hairs and to move them towards an erect position during the rotation of the rotary assembly;

said cutter device including a razor blade assembly contained within a replaceable cartridge attached to said handle and to said rotary assembly of the hair erecting device rotatably mounted to said handle; said rotatable assembly of the hair erecting device being rotatably mounted on a shaft to said handle, and said replaceable cartridge containing the razor blade assembly being formed with bayonet slots receiving the opposite ends of said shaft.

2. The apparatus according to claim 1, wherein said rotary assembly includes a cylindrical roller.

3. The apparatus according to claim 1, wherein said shaver head is formed with a plurality of spaced parallel ribs extending perpendicularly to said razor blade assembly to constrain the movement of the shaver head to the direction perpendicular to said blade assembly.

4. The apparatus according to claim 3, wherein there are a plurality of spaced parallel ribs in the outer surface of said replaceable cartridge.

5. The apparatus according to claim 1, wherein said handle includes a motor for rotating said rotary assembly.

6. The apparatus according to claim 1, wherein said razor blade assembly comprises a first razor blade spaced slightly rearwardly from said hair erecting rotary assembly, and a second razor blade spaced slightly rearwardly from said first razor blade, such that said first razor blade tends to cut the hair after erection by the hair erecting rotary assembly, and at the same time stretches the skin to cause the hairs uncut by the first razor blade, or the remnants of hairs cut by the first razor blade, to become erect for cutting by the second razor blade.

* * * * *